US009175370B2

(12) United States Patent
Roch

(10) Patent No.: US 9,175,370 B2
(45) Date of Patent: Nov. 3, 2015

(54) HARDENED MARTENSITIC STEEL HAVING A LOW COBALT CONTENT, PROCESS FOR MANUFACTURING A PART FROM STEEL, AND PART THUS OBTAINED

(75) Inventor: François Roch, Paris (FR)

(73) Assignee: AUBERT & DUVAL, Paris (FR)

( * ) Notice: Subject to any disclaimer, the term of this patent is extended or adjusted under 35 U.S.C. 154(b) by 694 days.

(21) Appl. No.: 13/054,028

(22) PCT Filed: Jul. 8, 2009

(86) PCT No.: PCT/FR2009/051351

§ 371 (c)(1),
(2), (4) Date: May 23, 2011

(87) PCT Pub. No.: WO2010/007297

PCT Pub. Date: Jan. 21, 2010

(65) Prior Publication Data

US 2011/0226386 A1 Sep. 22, 2011

(30) Foreign Application Priority Data

Jul. 15, 2008 (FR) ..... 08 54810

(51) Int. Cl.

| | |
|---|---|
| ***C23C 8/02*** | (2006.01) |
| ***C21D 6/04*** | (2006.01) |
| ***C22C 38/04*** | (2006.01) |
| ***C22C 38/22*** | (2006.01) |
| ***C22C 38/42*** | (2006.01) |
| ***C22C 38/10*** | (2006.01) |
| ***C22C 38/06*** | (2006.01) |
| ***C21D 1/32*** | (2006.01) |
| ***C21D 6/00*** | (2006.01) |
| ***C21D 9/00*** | (2006.01) |
| ***C21D 9/28*** | (2006.01) |
| ***C22C 38/00*** | (2006.01) |
| ***C22C 38/02*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |
| ***C22C 38/54*** | (2006.01) |

(52) U.S. Cl.

CPC . *C22C 38/06* (2013.01); *C21D 1/32* (2013.01); *C21D 6/004* (2013.01); *C21D 6/007* (2013.01); *C21D 6/04* (2013.01); *C21D 9/0068* (2013.01); *C21D 9/28* (2013.01); *C22C 38/001* (2013.01); *C22C 38/005* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/52* (2013.01); *C22C 38/54* (2013.01); *C21D 2211/008* (2013.01)

(58) Field of Classification Search

CPC ..... C21D 1/32; C21D 6/007; C21D 6/04; C21D 9/0068; C21D 6/004; C21D 9/28; C22C 38/54; C22C 38/001; C22C 38/005; C22C 38/02; C22C 38/04; C22C 38/06; C22C 38/42; C22C 38/44; C22C 38/46; C22C 38/48; C22C 38/52

See application file for complete search history.

(56) References Cited

U.S. PATENT DOCUMENTS

| | | | | |
|---|---|---|---|---|
| 4,605,321 | A * | 8/1986 | Brandenstein et al. | 384/512 |
| 4,832,525 | A * | 5/1989 | Morrison | 404/114 |
| 5,393,488 | A | 2/1995 | Rhoads et al. | |
| 5,727,317 | A * | 3/1998 | Bekku et al. | 29/898.06 |
| 6,715,921 | B2 * | 4/2004 | Mochizuki et al. | 384/415 |

FOREIGN PATENT DOCUMENTS

| | | |
|---|---|---|
| EP | 0648854 | 4/1995 |
| GB | 371334 | 4/1932 |
| GB | 1089934 | 11/1967 |
| GB | 1089935 | 11/1967 |
| WO | WO 2006114499 | 11/2006 |

* cited by examiner

*Primary Examiner* — Jessee Roe

(74) *Attorney, Agent, or Firm* — Davidson, Davidson & Kappel, LLC

(57) ABSTRACT

A steel characterized in that its composition is percentages by weight:

C=0.18-0.30%
Co=1.5-4%
Cr=2-5%
Al=1-2%
Mo+W/2=1-4%
V=traces-0.3%
Nb=traces-0.1%
B=traces-30 ppm
Ni=11-16% where Ni≥7+3.5 Al
Si=traces-1.0%
Mn=traces-2.0%
Ca=traces-20 ppm
Rare earths=traces-100 ppm
if N≤10 ppm, Ti+Zr/2=traces-100 ppm where Ti+Zr/2≤10 N
if 10 ppm<N≤20 ppm, Ti+Zr/2=traces-150 ppm
O=traces-50 ppm
N=traces-20 ppm
S=traces-20 ppm
Cu=traces-1%
P=traces-200 ppm
the remainder being iron and inevitable impurities resulting from the smelting. A process for manufacturing a part from this steel, and part thus obtained.

31 Claims, 1 Drawing Sheet

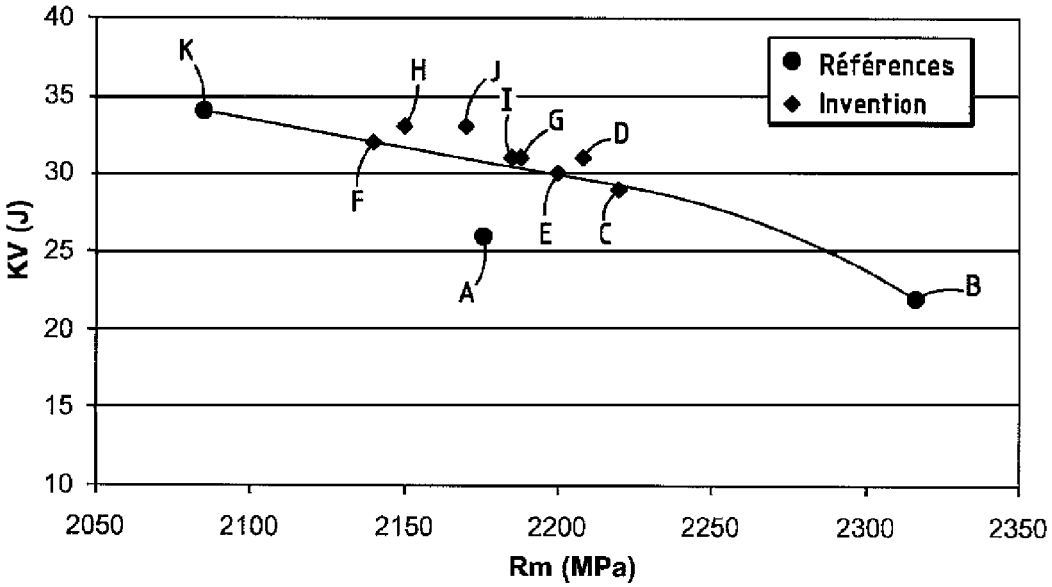
40
35
30
25
20
15
10
KV (J)
2050
2100
2150
2200
2250
2300
2350
Rm (MPa)
Références
Invention
K
H
J
I
G
D
F
E
C
A
B

HARDENED MARTENSITIC STEEL HAVING A LOW COBALT CONTENT, PROCESS FOR MANUFACTURING A PART FROM STEEL, AND PART THUS OBTAINED

The invention relates to martensitic steel hardened by a duplex system, i.e. by precipitation of intermetallic compounds and of carbides obtained by means of suitable composition of the steel and suitable heat ageing treatment.

BACKGROUND

This type of steel provides:

very high mechanical strength, but at the same time high toughness and ductility, in other words low sensitivity to brittle failure; this very high strength subsists under hot conditions up to temperatures of the order of 400° C.;

good fatigue properties, which notably implies the absence of harmful inclusions such as nitrides and oxides; this characteristic has to be obtained by a suitable composition and careful conditions for elaborating the liquid metal.

Further, it is carburizable and nitridable, so as to be able to harden its surface in order to give it good resistance to abrasion and lubricated friction.

Conceivable applications of this steel concern all fields of mechanics where structural or transmission parts are required which have to combine very high loads, under dynamic stresses and in the presence of induced or surrounding heating. In a non-exhaustive way, mention will be made of transmission shafts, gearbox shafts, bearing axles, . . . .

The requirement of excellent hot mechanical strength in certain applications prevents the use of carbon steels or so-called "weakly alloyed" steels, the strength of which starts to degrade from 200° C. Further, the toughness of these steels is generally no longer satisfactory when they are treated for mechanical strength levels of more than 2,000 MPa, and, generally, their "true" yield strength is much smaller than their maximum strength measured in the tensile test: the yield strength is therefore a dimensioning criterion which becomes a penalty in this case. Maraging steels may then be used, for which the yield strength limit is notably closer to their maximum tensile strength value, which have satisfactory strength up to 350-400° C., and which further provide good toughness for very high mechanical strength levels. But these maraging steels quite systematically contain high nickel, cobalt and molybdenum contents, all elements which are costly and subject to notable variations of their quotation on the commodity market. They also contain titanium, used for its strong contribution to secondary hardening, but which is mainly involved in the lowering of the fatigue strength of maraging steels due to the nitride TiN, the formation of which is quasi impossible to avoid during the smelting of steels even containing only a few tenths of percents.

In U.S. Pat. No. 5,393,488, a steel composition with secondary hardening was proposed without addition of titanium, aiming at improving hot strength and especially improving fatigue properties, ductility and toughness. This composition has the drawback of requiring a high Co content (8 to 16%), which makes the steel very expensive (N.B.: in the present text, all the contents of the different elements are expressed in weight %).

In document WO-A-2006/114499, a composition of hardened martinsitic steel was proposed as well as an optimized series of heat treatments adapted to this composition which, relatively to the prior art represented by U.S. Pat. No. 5,393,388, have the advantage of only requiring a more reduced cobalt content i.e. between 5 and 7%. By adjusting the contents of the other elements and the parameters of the heat treatments, accordingly, it was possible to obtain parts providing a set of very satisfactory mechanical properties, notably for aeronautical applications. These notably are a cold tensile strength comprised between 2,200 MPa and 2,350 MPa, ductility and resilience at least equal to those of the best high-strength steels, and under hot conditions (400° C.), a tensile strength of the order of 1,800 MPa, as well as optimum fatigue properties.

This steel is said to be "with duplex hardening" since its hardening is obtained by simultaneous hardening precipitation of intermetallic compounds and of carbides of the $M_2C$ type.

However, this steel always contains relatively large amounts of cobalt. As this element is in any case expensive and its price is likely to be subject to significant fluctuations on the commodity market, it would be important to find means for further reducing its presence very substantially, notably in materials intended for more ordinary mechanical applications than aeronautical applications.

With the steels as proposed in WO-A-20061114499 and U.S. Pat. No. 5,393,488, it is possible to obtain good resilience but for certain applications the latter may prove to be insufficient.

For the same applications, obtaining a very high tensile strength (Rm) is also required.

SUMMARY OF THE INVENTION

An object of the invention is to provide a steel which may notably be used for manufacturing mechanical parts such as transmission shafts, or structural members, having higher resilience while having a significant mechanical strength. This steel should also have a lower manufacturing cost than the most performing steels presently known for these uses, in particular by a significantly more reduced cobalt content.

The invention provides a steel characterized in that its composition is in weight percentages:

C=0.18-0.30%
Co=1.5-4%, preferably 2-3%
Cr=2-5%
Al=1-2%
Mo+W/2=1-4%
V=traces-0.3%
Nb=traces-0.1%
B=traces-30 ppm
Ni=11-16% where Ni≥7+3.5 Al
Si=traces-1.0%
Mn=traces-2.0%
Ca=traces-20 ppm
Rare earths=traces-100 ppm
if N≤10 ppm, Ti+Zr/2=traces-100 ppm where Ti+Zr/2≤10 N
if 10 ppm<N≤20 ppm, Ti+Zr/2=traces-150 ppm
O=traces-50 ppm
N=traces-20 ppm
S=traces-20 ppm
Cu=traces-1%
P=traces-200 ppm
the remainder being iron and inevitable impurities resulting from the smelting.

It preferably contains C=0.20-0.25%.
It preferably contains Cr=2-4%.
It preferably contains Al=1-1.6%, better 1.4-1.6%.
It preferably contains Mo≥1%.
It preferably contains Mo+W/2=1-2%.
It preferably contains V=0.2-0.3%.

It preferably contains Ni=12-14%, with Ni≥7+3.5 Al.

It preferably contains Nb=traces-0.05%

It preferably contains Si=traces-0.25%, better traces-0.10%.

It preferably contains O=traces-10 ppm.

It preferably contains N=traces-10 ppm.

It preferably contains S=traces-10 ppm, better traces-5 ppm.

It preferably contains P=traces-100 ppm.

Its measured martensitic transformation temperature Ms is preferably greater than or equal to 100° C.

Its measured martensitic transformation temperature Ms may be greater than or equal to 140° C.

The present invention provides a method for manufacturing a steel part, characterized in that it includes the following steps preceding the finishing of the parts which gives it its definitive shape:

preparation of a steel having the previous composition;

at least one operation for shaping this steel;

softening tempering at 600-675° C. for 4 to 20 hrs followed by cooling in air;

solution heat treatment at 900-1,000° C. for at least 1 hr, followed by sufficiently fast cooling in oil or air in order to avoid precipitation of intergranular carbides in the austenite matrix;

age hardening at 475-600° C., preferably 490-525° C. for 5-20 hrs.

It further preferably includes a cryogenic treatment at −50° C. or lower, preferably between −80° C. and −100° C. or lower but not below −110° C., in order to transform all of the austenite into martensite, the temperature being 150° C. lower or more than the measured Ms, at least one of said treatments lasting between 4 hrs and 50 hrs and preferably between 4 hrs and 10 hrs.

It further preferably includes a treatment for softening crude quenched martensite carried out at 150-250° C. for 4-16 hrs, followed by quiet air cooling.

The part also preferably undergoes carburization, or nitridation, or carbonitridation.

Nitridation, or cementation, or carbonitridation may be carried out during an ageing cycle.

A nitridation may be carried out between 475 and 600° C.

Said nitridation or carburization or carbonitridation may be carried out during a thermal cycle before or simultaneously with said solution heat treatment.

The invention also provides a mechanical part or part for a structural member, characterized in that it is manufactured according to the previous method.

This may notably be an engine transmission shaft, or an engine suspension device or a landing gear member or a gearbox member or a bearing axle.

As this will have been understood, the invention is first based on a steel composition which is distinguished from the prior art represented by WO-A-20061114499 notably by lower Co content but remaining significant, comprised between 1.5 and 4%. The contents of the other most frequent significantly present alloy elements are only modified very little, but certain contents of impurities have to be carefully controlled.

Co is a costly element, the content of which has been significantly reduced as compared with the prior art, without however suppressing it or bringing it to a very low level. The steel according to the invention generally contains rather few costly addition elements, apart from nickel, the content of which is not however increased as compared with the prior art. But, particular care should be taken during the smelting in order to limit the nitrogen content to at most 20 ppm in order to avoid as far as possible formation of aluminium nitrides. The maximum titanium and zirconium contents also have to be limited accordingly in order to prevent them from forming nitrides with residual nitrogen.

The steel of the invention may be machined in the quenched state, with tools adapted to a hardness of 45HRC. It is intermediate between maraging steels (which are crude quenched machinable steels since they have low carbon soft martensite) and carbon steels which have to be essentially machined in the annealed state.

BRIEF DESCRIPTION OF THE DRAWINGS

The invention will be better understood upon reading the description which follows, given with reference to the appended FIG. 1, which shows, for samples of various compositions, their tensile strength Rm and their toughness Kv.

DETAILED DESCRIPTION

In the steels of the class of those of the invention, "duplex" hardening is carried out, i.e. obtained together by intermetallic compounds of the β-NiAl type and by carbides of the $M_2C$ type, in the presence of reversion austenite formed/stabilized by nickel enrichment obtained by diffusion during age hardening, which gives ductility to the structure by the formation of a sandwich structure (a few % of stable and ductile austenite between the laths of hardened martensite).

The formation of nitrides, of Ti, Zr and Al notably, should be avoided, which are embrittling: they deteriorate the toughness and fatigue strength. As these nitrides may precipitate from contents of 1 to a few ppm of N in the presence of Ti, Zr and/or Al and as conventional smelting means make it difficult to attain less than 5 ppm of N, the steel of the invention observes the following rules.

In principle, any addition of Ti is limited (maximum allowed: 100 ppm), and N is limited as far as possible. According to the invention the N content should not exceed 20 ppm and, better 10 ppm, and the Ti content should not exceed 10 times the N content.

Nevertheless, proportioned addition of titanium at the end of the smelting in the oven under vacuum is conceivable in order to bind the residual nitrogen and thereby avoid harmful precipitation of the nitride AlN. As however formation of the nitride TiN in the liquid phase should be avoided since it becomes coarse (from 5 to 10 μm or more), addition of titanium should only be carried out for a maximum residual nitrogen content of 10 ppm in the liquid metal, and always without exceeding 10 times this residual nitrogen value. For example, for a final content of 8 ppm of N at the end of the smelting, the limiting content of possible addition of titanium is 80 ppm.

Ti may be partly or totally replaced with Zr, both of these elements having a quite comparable behavior. As their atomic masses are in a ratio of 2, if Zr is added in addition to or instead of Ti, one should think in terms of the sum Ti+Zr/2 and state that, while N≤10 ppm:

Ti+Zr/2 should always be ≤100 ppm;

and Ti+Zr/2 should be ≤10 N.

In the case when the N content is greater than 10 ppm and less than or equal to 20 ppm, Ti and Zr should be considered as impurities which should be avoided, and the sum Ti+Zr/2 should be ≤150 ppm.

Possible addition of rare earths at the end of the smelting may also contribute in binding a fraction of N, in addition to S and O. In this case, it should be made sure that the residual rare earth content in free form remains less than or equal to 100 ppm, and preferentially less than or equal to 50 ppm since these elements embrittle steel when they are present beyond these values. It is believed that oxynitrides of rare earths (for example La) are less harmful than nitrides of Ti or Al, because of their globular shape which would make them less likely to form fatigue break initiation points.

A calcium treatment may be performed in order to complete the deoxidation/desulfurization of the liquid metal. This treatment is preferentially conducted with possible additions of Ti, Zr or rare earths.

The carbide $M_2C$ of Cr, Mo, W and V containing very little Fe is preferred for its hardening and non-embrittling properties. The carbide $M_2C$ is metastable with regard to the equilibrium carbides $M_7C_3$ and/or $M_6C$ and/or $M_{23}C_6$. It is stabilized by Mo and W. The sum of the Mo content and half the W content should be at least 1%. However, Mo+W/2=4% should not be exceeded in order not to deteriorate forgeability (or hot deformability as a rule) and not to form intermetallic μ phase compounds of the $Fe_7Mo$ type, which is one of the essential hardening phases of standard maraging steels but is not desired in the steel of the invention. Preferably, Mo+W/2 is comprised between 1 and 2%. It is also for avoiding the formation of non-hardening Ti carbides likely to embrittle the grain boundaries that an imperative limitation of the Ti content to 100 ppm of the steels according to the invention is required.

Cr and V are elements which activate the formation of "metastable" carbides.

V also forms carbides of the MC type, stable up to temperatures of solution heat treatment, which "block" the grain boundaries and limit the growth of grains during high temperature heat treatments. V=0.3% should not be exceeded in order not to bind too much C in V carbides, during the solution heat treatment cycle, to the detriment of the carbide $M_2C$ of Cr, Mo, W, V, the precipitation of which is sought during the subsequent ageing cycle. Preferably the V content is comprised between 0.2 and 0.3%.

The presence of Cr (at least 2%) allows a reduction in the level of V carbides and an increase in the level of $M_2C$. 5% should not be exceeded in order not to promote too much the formation of stable carbides, in particular, $M_{23}C_6$. Preferably 4% of Cr will not be exceeded.

The presence of C promotes the occurrence of $M_2C$ relatively to the μ phase. But excessive content causes segregations, a lowering of Ms and leads to difficulties during manufacturing on an industrial scale: sensitivity to clinks (surface cracks during fast cooling), difficult machinability of a too hard martensite in the crude quenched state . . . . Its contents should be comprised between 0.20 and 0.30%, preferably 0.20%-0.25%. The surface layer of the parts may be enriched with C by carburization or carbonitridation if very large surface hardness is required in the contemplated applications.

Cobalt somewhat raises the ductile/brittle transition temperature which is not favorable in particular in compositions with rather low nickel contents, while, unlike what was noticeable in other steels, cobalt does not obviously raise the Ms transformation point of the compositions of the invention and is therefore of not any obvious interest either in this regard.

The Co content (5 to 7%) proposed in the steels of WO-A-2006/114499, in combination with the contents of other elements, resulted from the search for a compromise between these various advantages and drawbacks.

As this was stated, the invention is first based on a steel composition which is distinguished from the prior art represented by WO-A-2006/114499 notably by a lower Co content, comprised between 1.5 and 4%, better between 2 and 3%. The contents of the most frequent significantly present alloy elements are only modified a little, but certain impurity contents have to be controlled carefully, notably the Ti, Zr and N contents which affect toughness.

Within the context of an exploration of the effect of Co on the mechanical properties of this type of steel (Rm and Kv), it was unexpectedly shown that by adjusting the concentration of this element it was possible to obtain the best resilience/Rm compromise. This discovery is illustrated in FIG. 1 in which it is seen that a population of points Rm/Kv is distributed around a polynomial curve of order 3 having an inflection for Co contents comprised between 1.5 and 4% of Co. A resilience of the order of 30 Joules or more and an Rm greater than or equal to 2,140 MPa are simultaneously obtained in this Co content range.

Having an unnecessarily high Co concentration should be avoided, which not only is very expensive, but also degrades resilience. It is known that Co degrades the resilience transition of pure Fe, (pages 52-54, Materials Sciences and Technology January 1994 Vol. 10). Indeed, as this was stated, the presence of Co increases the ductile/brittle transition temperature. Moreover a Co content of more than 1.5% of Co proves to be useful for improving structural hardening by precipitation of carbide $M_2C$ and thereby significantly increasing Rm. Further, surprisingly, the inventors noticed that after several tests, a Co content comprised between about 1.5 and 4%, better between 2 and 3%, significantly improves mechanical strength practically without degrading resilience, as compared with a grade having very low Co content (<1%), the composition of which would moreover be identical.

Ni and Al are related in the invention, wherein Ni should be ≥7+3.5 Al. These are two essential elements which are involved for a large part in age hardening, by means of the precipitation of the nanometric intermetallic phase of the B2 type (NiAl for example). It is this phase which gives a great part of the hot mechanical strength up to about 400° C. Nickel is also the element which reduces brittleness by cleavage since it lowers the ductile/brittle transition temperature of martensites. If Al is too high relatively to Ni, the martensitic matrix is too strongly depleted in nickel following the precipitation of the precipitate which hardens NiAl during ageing. This is damageable for toughness and ductility criteria, since the lowering of the nickel content in the martensitic phase leads to the raising of its ductile/fragile transition temperature, therefore to its embrittlement at temperatures close to room temperature. Further, nickel promotes the formation of reversion austenite and/or stabilizes the residual austenite fraction (possibly present), during the ageing cycle. These mechanisms are favorable to the ductility and toughness criteria, but also to those of structural stability of the steel. If the aged matrix is too depleted in nickel, these virtuous mechanisms are reduced or inhibited: there is no longer any reversion austenite potential. Conversely if there is too much Ni, the level of NiAl type hardening phase is exaggeratedly reduced, by exaggerating the reversion austenite level in which Al remains widely in solution.

At the end of the quench, there should not be any residual austenite (<3%), and an essentially martensitic structure should be found. For this purpose, the conditions of quenching have to be adjusted, in particular the temperature at the end of cooling, and also the composition of the steel. The latter determines the temperature Ms of the onset of the martensitic transformation, which, according to the invention should preferably remain equal to or greater than 140° C. if no cryogenic cycle is practiced, and should preferably be comprised between 100 and 140° C. if a cryogenic cycle is practiced.

Ms is usually calculated according to the standard formula of the literature: Ms=550-350×C %-40×Mn %-17×Cr %-10×Mo %-17×Ni %-8×W %-35×V %-10×Cu %-10×Co %+30×Al %° C. However, experience shows that this formula is only a very rough estimation, in particular because the effects of Co and of Al are very variable from one type of steel to another. In order to know whether a steel is compliant with the invention or not, it is therefore necessary to rely on measurements of the actual Ms temperature, for example carried out by dilatometry as this is conventional. The Ni content is one of the possible adjustment variables for Ms.

The temperature at the end of cooling after quenching should be less than the actual Ms−150° C., preferentially less than the actual Ms−200° C., in order to ensure full martensitic transformation of the steel. The temperature at the end of cooling should therefore be less than the temperature Ms measured at the end of the martensitic transformation of the steel. For compositions which are the most enriched with C and Ni in particular, a cryogenic treatment may immediately be applied following cooling to room temperature from the solution heat treatment temperature. The overall cooling rate should be as high as possible in order to avoid stabilization mechanisms of the carbon-rich residual austenite. However it is unnecessary to seek cryogenic temperatures below −110° C. since thermal agitation of the structure becomes insufficient therein for producing the martensitic transformation. Generally, it is preferable that the value Ms of the steel be comprised between 100 and 140° C. if a cryogenic cycle is applied, and greater than or equal to 140° C. in the absence of this cryogenic cycle. As already applied for martensitic steels hardened by a duplex system and as already known from WO-A-2006/114499, the duration of the cryogenic cycle, if necessary, is comprised between 4 and 50 hours, preferentially from 4 to 16 hours, and still preferentially from 4 to 10 hours. Several cryogenic cycles may be practiced, it being essential that at least one of them has the aforementioned characteristics.

In concrete terms, one should have Al=1-2%, preferably 1-1.6%, better 1.4-1.6%, and Ni=11-16%, with Ni≥7+3.5 Al. Ideally, one has 1.5% of Al and 12-14% of Ni. These conditions promote the presence of NiAl which increases the tensile strength Rm, which is also found to be not too deteriorated by the low Co content if the other conditions of the invention are met. The yield strength $R_{p0.2}$ is influenced in the same way as Rm.

As compared with steels known from U.S. Pat. No. 5,393,488, where a very high presence of reversion austenite is sought in order to have high ductility and toughness, the steels of the class of the invention prefer the presence of hardening phases B2, notably NiAl, in order to obtain high hot mechanical strength. Observance of the conditions on Ni and Al which have been given ensures a sufficient potential content of reversion austenite in order to preserve ductility and toughness suitable for the contemplated applications.

It is possible to add B, but not more than 30 ppm in order not to degrade the properties of the steel.

It is also possible to add Nb for controlling the size of the grains during forging or another hot transformation, at a content which does not exceed 0.1%. The steel according to the invention therefore accepts raw materials which may contain non-negligible residual Nb contents.

A characteristic of the steels of the class of the invention is also the possibility of replacing at least one portion of Mo with W. At an equivalent atomic fraction, W segregates less upon solidification than Mo and provides a surplus of hot mechanical strength. It has the drawback of being costly and this cost may be optimized by associating it with Mo. As this was stated, Mo+W/2 should be comprised between 1 and 4%, preferably between 1 and 2%. A minimum Mo content of 1% is preferably retained in order to limit the cost of the steel, all the more so since high temperature strength is not a priority objective of the steel of the invention.

Cu may range up to %. It is likely to be involved in hardening by means of its epsilon phase, and with the presence of Ni, its harmful effects may be limited, in particular the occurrence of surface cracks upon forging parts, which are seen during additions of copper in steels which do not contain nickel. But its presence is by no means indispensable and it may only be present in the state of residual traces, stemming from pollutions of raw materials.

Manganese is a priori not useful for obtaining the sought properties of the steel, but it does not have any recognized detrimental effect. Further, its low vapor pressure at liquid steel temperatures causes its concentration to be controllable with difficulty during its smelting under vacuum and remelting under vacuum: its content may vary depending on the radial and axial localization in a remelted ingot. As it is often present in raw materials and for the reasons above, its content will preferentially be of 0.25% at most, and in any case limited to at most 2%, since too large variations of its concentration in a same product will be detrimental to the repetitiveness of the properties.

Silicon is known to have a ferrite solid solution hardening effect, and like cobalt, to reduce the solubility of certain elements or certain phases in the ferrite. Nevertheless, as this has been seen, the steel of the invention only includes relatively little cobalt, and it may do without silicon, all the more so since, additionally, silicon generally promotes precipitation of detrimental intermetallic phases in complex steels (Laves phase, silicides . . . ). Its content will be limited to 1%, preferentially to less than 0.25% and still preferentially less than 0.1%.

Generally, the elements which may segregate to the grain boundaries and embrittle them such as P and S should be controlled within the following limited: S=traces-20 ppm, preferably traces-10 ppm, better traces-5 ppm, and P=traces-200 ppm, preferably traces-100 ppm, better traces-50 ppm.

Ca may be used as a deoxidant and as a sulfur scavenger, and it is finally found residually (≤20 ppm). Also, rare earth residues may finally subsist (≤100 ppm) following a treatment for refining the liquid metal where they would have been used for capturing O, S and/or N. The use of Ca and of rare earths for these purposes is not mandatory, these elements may only be present as traces in the steels of the invention.

The acceptable oxygen content is 50 ppm at most, preferably 10 ppm at most.

As examples, steel samples were tested for which the compositions (in weight percentages) are copied into Table 1:

TABLE 1

| Composition of the test samples | | | | | | | | | | | |
|---|---|---|---|---|---|---|---|---|---|---|---|
| | A | B | Field of the Invention | | | | | | | | |
| | (ref.) | (ref.) | C | D | E | F | G | H | I | J | K (ref.) |
| C % | 0.233 | 0.239 | 0.22 | 0.23 | 0.24 | 0.21 | 0.24 | 0.22 | 0.18 | 0.23 | 0.21 |
| Si % | 0.082 | 0.031 | 0.029 | 0.033 | 0.041 | 0.045 | 0.053 | 0.036 | 0.065 | 0.30 | 0.052 |
| Mn % | 0.026 | 0.033 | 0.032 | 0.035 | 0.028 | 0.035 | 0.039 | 0.041 | 0.38 | 0.052 | 0.061 |

TABLE 1-continued

| Composition of the test samples | | | | | | | | | | | |
|---|---|---|---|---|---|---|---|---|---|---|---|
| | A | B | Field of the Invention | | | | | | | | |
| | (ref.) | (ref.) | C | D | E | F | G | H | I | J | K (ref.) |
| S ppm | 1 | 4 | 7 | 4 | 6 | 7 | 3 | 8 | 10 | 5 | 4 |
| P ppm | 54 | 30 | 29 | 31 | 30 | 25 | 15 | 28 | 80 | 45 | 29 |
| Ni % | 13.43 | 12.67 | 13.31 | 12.42 | 12.30 | 14.11 | 12.99 | 12.70 | 15.10 | 11.25 | 12.91 |
| Cr % | 2.76 | 3.38 | 2.99 | 3.05 | 3.21 | 3.19 | 2.95 | 3.25 | 3.17 | 3.17 | 2.89 |
| Mo % | 1.44 | 1.52 | 1.61 | 1.52 | 1.49 | 1.46 | 1.47 | 1.51 | 1.48 | 1.55 | 1.46 |
| Al % | 0.962 | 1.50 | 1.45 | 1.50 | 1.60 | 1.54 | 1.46 | 1.49 | 1.53 | 1.48 | 1.39 |
| Co % | 10.25 | 6.18 | 3.93 | 3.50 | 3.02 | 2.98 | 2.56 | 2.30 | 2.02 | 1.72 | 0.5 |
| Cu % | 0.014 | 0.011 | <0.010 | 0.011 | 0.010 | <0.010 | 0.025 | 0.35 | 0.052 | 0.061 | 0.032 |
| Ti % | <0.02 | <0.020 | <0.020 | <0.020 | <0.020 | <0.020 | 0.025 | <0.02 | <0.02 | <0.02 | <0.02 |
| Nb % | <0.05 | <0.0050 | <0.0050 | 0.050 | <0.0050 | 0.015 | <0.005 | <0.005 | <0.005 | <0.005 | <0.005 |
| B ppm | <10 | <5 | <5 | <5 | <5 | <5 | <5 | 28 | 15 | <5 | <5 |
| Ca pm | <50 | <50 | <50 | <50 | <50 | 60 | <50 | <50 | <50 | <50 | <50 |
| N ppm | <3 | 13 | 4 | 7 | 5 | 10 | 6 | 3 | 6 | <3 | <3 |
| O ppm | <3 | 3.4 | 4 | 3 | 10 | 15 | <3 | 12 | <3 | 20 | 6 |
| V % | <0.01 | 0.245 | 0.251 | <0.010 | 0.248 | 0.243 | <0.010 | 0.115 | 0.292 | 0.241 | <0.010 |

The elements which are not mentioned in the table are only present at most as traces resulting from the smelting.

The reference steel A corresponds to a steel according to U.S. Pat. No. 5,393,488, having high Co content.

The reference steel B corresponds to a steel WO-A-20061114499, it differs from A by lower Co content and higher Al content.

The steels C to J are compliant with the invention in all respect, notably by their Co content, significantly lower than that of the steel B, but which nevertheless remains substantially greater than a simple residual content and is obtained by deliberate addition during smelting.

The steel C differs from the reference steel B essentially by lower Co content.

The steel D differs from C by a slightly lower Co content for a lower Ni content, and by the absence of V which is only present as traces.

The steel E differs from D by a still lower Co content than that of D and by a V content at a level comparable with the steel C.

The steel F differs from C, D, E essentially by a slightly greater Ni content, its Co content being comparable with that of the steel E.

The steel G differs from steels C to F by a further reduced Co content and does not include any V.

The steel H differs from the steel G by further enhanced lowering of the Co content and by a significantly higher boron content.

The steel I differs from the steel H by further enhanced lowering of the Co content, and by lower C content associated with higher Ni content.

The steel J is the one for which the composition has the lowest Co content, while corresponding to voluntary addition and which remains compliant with the invention. It also has the lowest Ni content and includes V.

The reference steel K has a low Co content below the minimum required by the invention. It is comparable on the other points to steels according to the invention without any V and B and with very low N.

These samples were forged from 200 kg ingots as flat members of 75×35 mm under the following conditions. A homogenization treatment of at least 16 hours at 1,250° C. is followed by a first forging operation intended to split up the coarse structures of the ingots; half-products with a square section of 75×75 mm were then forged after re-thermalization at 1180° C.; finally, each half-product was placed in an oven at 950° C., and was then forged at this temperature in the form of flat members of 75×35 mm, the granular structure of which is refined by these successive operations.

Further, the samples were subject to softening tempering at a temperature of at least 600° C. In this case, this softening tempering was carried out at 650° C. for 8 hrs and followed by cooling in air. By means of this, the crude products of thermo-mechanical transformations may undergo without any particular problems the finishing operations (straightening, scalping, machining . . . ) giving the part its definitive shape. It will be noted that softening tempering does not provide any contribution to obtaining the final mechanical characteristics.

After the forging, the samples were subject to:

a solution heat treatment at 900° C. for 1 hr and then to cooling by quenching in oil;

in a way known per se and as already applied for martensitic steels hardened by a duplex system such as for example the steel of WO-A-2006/114499: cryogenic treatment at −80° C. for 8 hrs for the samples A, B, C, E, G, I, J and K; the samples D and H were subject to a cryogenic treatment at −90° C. for 7 hrs and sample F to a treatment at −100° C. for 6 hrs;

stress-relieving tempering for 16 hrs at 200° C.;

age hardening at 500° C. for 10 hrs and then cooling in air.

The properties of the samples (tensile strength Rm in the longitudinal direction, yield strength $Rp_{0.2}$, elongation A5d, striction Z, resilience KV, ASTM grain size) are copied into Table 2. They are measured here at normal room temperature.

TABLE 2

| Properties of the tested samples | | | | | | | | |
|---|---|---|---|---|---|---|---|---|
| | | Co | $R_m$ (Mpa) | $Rp_{0.2}$ (Mpa) | A5d (%) | Z (%) | KV (J) | Grain ASTM |
| Ref. | A | 10.25 | 2176 | 1956 | 11.2 | 58 | 25/27 | 8 |
| | B | 6.18 | 2316 | 2135 | 9.5 | 49 | 20/24 | 8 |
| Inv. | C | 3.93 | 2220 | 2030 | 10.1 | 52 | 29 | 7 |
| | D | 3.50 | 2208 | 2011 | 10.3 | 55 | 31 | 9 |
| | E | 3.02 | 2200 | 1998 | 10.3 | 55 | 30 | 8 |
| | F | 2.98 | 2140 | 1935 | 10.9 | 61 | 32 | 7 |
| | G | 2.56 | 2188 | 1975 | 10.7 | 60 | 31 | 7 |
| | H | 2.30 | 2150 | 1945 | 10.6 | 61 | 33 | 8 |
| | I | 2.02 | 2185 | 1970 | 10.4 | 59 | 31 | 7 |
| | J | 1.72 | 2170 | 1943 | 10.4 | 60 | 33 | 8 |
| Ref. | K | 0.5 | 2085 | 1891 | 11.1 | 62 | 34 | 7 |

It is seen that the samples according to the invention, C to J, have tensile properties which are comparable to A and B but also clearly improved resilience due to significant lowering of the Co content.

Moreover, the inventors noticed that after several tests, a Co content comprised at between 1.5 and 4% significantly improves mechanical strength, practically without degrading the resilience as compared with the reference sample K with 0.5% Co. With the sample K with less than 1.5% Co, it is possible to maintain also good resilience, but with reduced tensile strength.

It was unexpectedly shown that with the Co concentration according to the invention the best resilience/Rm compromise may be obtained. This discovery is illustrated in FIG. 1 in which it is seen that a population of points Rm/Kb is distributed around a polynomial curve of order 3 having inflection between 1.5 and 4% of Co. A resilience of the order of 30 Joules or more and Rm greater than or equal to 2,140 MPa are obtained in this range of Co contents.

The sought strength/resilience compromise may moreover be refined by modifying the ageing conditions, but adjustment of the Co content remains the essential parameter which has to be acted upon in order to obtain this compromise.

The hardening provided by the increase in Al, with high Ni, in order to form the hardening phase NiAl, is not proportional to the Al concentration and exceeding a value of 2% Al does not provide any significant gain in the tensile strength.

The Nb and B additions of the samples D and H respectively are not necessary for obtaining high mechanical strengths which are in priority targeted in steels of the class of the invention. However, by adding Nb, it is possible to refine the grain size, described by the conventional ASTM index (the highest ASTM values correspond to the finest grains).

After softening tempering at 650° C. for 8 hrs and cooling in air, with a solution heat treatment at 935° C. for 1 hour followed by cooling in oil, and then with a cryogenic treatment at −80° C. for 8 hrs or at −90° C. for 7 hrs or further at −100° C. for 6 hrs, and then detensioning at 200° C. for 8 hrs (on tensile specimens) or for 16 hrs (on resilience specimens), and then by ageing at 500° C. for 12 hrs followed by cooling in air, it was possible to obtain in the longitudinal direction at 20° C. an excellent compromise between tensile strength, ductility and resilience.

Complementary experiments show that in the cross-direction, the resilience values remain acceptable. At 400° C., the tensile strength remains very high and relatively low Co contents are compatible with the sought properties Generally, an optimized heat treatment method for the steel according to the invention in order to finally obtain a part having the desired properties, after shaping the blank of the part and before the finishing providing the part with its definitive shape, is the following:

softening tempering at 600-675° C. for 4 to 20 hrs followed by cooling in air;

solution heat treatment at 900-1,000° C. for at least 1 hr, followed by sufficiently fast cooling with oil or air in order to avoid precipitation of granular carbides in the austenite matrix;

if necessary, cryogenic treatment at −50° C. or lower, preferably between −80° C. and −100° C. or lower but not below −110° C., in order to transform all the austenite into martensite, the temperature being less than Ms by 150° C. or more, preferentially less than Ms by about 200° C., at least one of said cryogenic treatments lasting for at least 4 hrs and at most 50 hrs and preferably between 4 hrs and 10 hrs; for compositions notably having a relatively low Ni content which leads to a relatively high temperature, Ms, this cryogenic treatment is less useful; the duration of the cryogenic treatment notably depending on the bulkiness of the part to be treated;

optionally a treatment for softening the crude quenched martensite carried out at 150-250° C. for 4-16 hrs, followed by quiet air cooling;

age hardening at 475-600° C., preferably at 490-525° C. for 5-20 hrs; ageing below 490° C. is not always recommended since the metastable carbide $M_3C$ may still be present and would provide brittleness to the structure; ageing beyond 525° C. may cause a loss of mechanical strength by ageing, without any notable gain in toughness or ductility.

In the examples which have been described, the operations for shaping the steel following its casting and preceding the softening tempering and the other heat treatments consisted in forging. But other types of hot and/or cold shaping thermomechanical treatments may be performed in addition to or instead of this forging, depending on the type of final product which one desires to obtain (die-stamped parts, bars, half-products . . . ). Mention may notably be made of rolling operation(s), die-stamping, stamping . . . as well as a combination of several of such treatments.

The preferred applications of the steel according to the invention are long-lasting parts for mechanical engineering and structural members, for which a cold tensile strength of more than 2,150 MPa should be available, combined with resilience values greater than those of the best high strength steels, and under hot conditions (400° C.) a tensile strength of the order of 1,800 MPa, as well as optimum fatigue properties.

The steel according to the invention also has the advantage of being carburizable, nitridable and carbonitridable. It is therefore possible to impart to the parts using it, high abrasion resistance without affecting its core properties. This is particularly advantageous in the contemplated applications which have been mentioned.

Carburization, or nitridation, or carbonitridation, may optionally be carried out during the solution or ageing heat treatments instead of being carried out during a separate step. In particular, nitridation may be carried out between 475 and 500° C. during an ageing cycle.

The invention claimed is:

1. A method for producing a part from steel, the method comprising the following steps preceding the finishing of the part providing it with its definitive shape:

preparing a steel part having a steel composition comprising, in weight percentages, the following:

C=0.18 to 0.30%;
Co=1.5 to 4%;
Cr=2 to 5%;
Al=1 to 2%;
Mo+W/2=1 to 4%;
V=traces to 0.3%;
Nb=traces to 0.1%;
B=traces to 30 ppm;
Ni=11 to 16%;
Si=traces to 1.0%;
Mn=traces to 2.0%;
Ca=traces to 20 ppm;
Rare earths=traces to 100 ppm;
if N≤10 ppm, Ti+Zr/2=traces to 100 ppm where Ti+Zr/2≤10×N;
if 10 ppm<N≤20 ppm, Ti+Zr/2=traces to 150 ppm;
O=traces to 50 ppm;
N=traces to 20 ppm;
S=traces to 20 ppm;
Cu=traces to 1%;
P=traces to 200 ppm; and the remainder being iron and inevitable impurities resulting from smelting, the composition of the steel simultaneously satisfying the relationship Ni≥7+(3.5×Al);

shaping the steel part by at least one operation;

softening tempering the steel part at 600 to 675° C. for 4 to 20 hours followed by cooling in air;

treating the steel part with a solution heat treatment at 900 to 1,000° C. for at least 1 hour, followed by fast cooling the steel part in oil or air to avoid precipitation of intergranular carbides in an austenite matrix; and age hardening the steel part at 475 to 600° C., for 5 to 20 hours.

2. The method according to claim 1 wherein the age hardening is performed at 490 to 525° C.

3. The method for manufacturing a steel part according to claim 1 further comprising treating the steel part with a cryogenic treatment at −50° C. or lower, transforming all the austenite into martensite, wherein the temperature is less than a measured Ms by 150° C. or more, wherein the cryogenic treatment lasts between 4 hours and 50 hours.

4. The method for manufacturing a steel part according to claim 3 wherein the cryogenic treatment is performed between −80° C. and −110° C.

5. The method for manufacturing the steel part according to claim 3 wherein the cryogenic treatment is between 4 hours and 10 hours.

6. The method for manufacturing a steel part according to claim 1 further comprising a treatment for softening a crude quenched martensite carried out at 150 to 250° C. for 4 to 16 hours, followed by quiet air cooling.

7. The method for manufacturing a steel part according to claim 1 further comprising the steel part undergoing carburization or nitridation or carbonitridation.

8. The method for manufacturing a steel part according to claim 7 wherein the nitridation or carburization or carbonitridation is carried out during an ageing cycle.

9. The method for manufacturing a steel part according to claim 8 wherein the nitridation is carried out between 475 to 600° C.

10. The method for manufacturing a steel part according to claim 7 wherein the nitridation or carburization or carbonitridation is carried out during a thermal cycle before or simultaneously with the solution heat treatment.

11. A mechanical part or part for a structural member, wherein the part is manufactured by the method according to claim 1.

12. The mechanical part according to claim 11 wherein the mechanical part is one of an engine transmission shaft, an engine suspension device, a landing gear member, a gearbox member or a bearing axle.

13. The method for manufacturing a steel part according to claim 1 wherein the steel composition contains between 2 to 3% of Co.

14. The method for manufacturing a steel part according to claim 1 wherein the steel composition contains between 0.20 to 0.25% of C.

15. The method for manufacturing a steel part according to claim 1 wherein the steel composition contains between 2 to 4% of Cr.

16. The method for manufacturing a steel part according to claim 1 wherein the steel composition contains between 1 to 1.6% of Al.

17. The method for manufacturing a steel part according to claim 1 wherein the steel composition contains between 1.4 to 1.6% of Al.

18. The method for manufacturing a steel part according to claim 1 wherein the steel composition contains between 1 to 4% of Mo.

19. The method for manufacturing a steel part according to claim 1 wherein the steel composition contains Mo+W/2 being between 1 to 2%.

20. The method for manufacturing a steel part according to claim 1 wherein the steel composition contains between 0.2 to 0.3% of V.

21. The method for manufacturing a steel part according to claim 1 wherein the steel contains Ni=12 to 14%.

22. The method for manufacturing a steel part according to claim 1 wherein the steel composition contains between traces to 0.05% of Nb.

23. The method for manufacturing a steel part according to claim 1 wherein the steel composition contains between traces to 0.25% of Si.

24. The method for manufacturing a steel part according to claim 23 wherein the steel composition contains between traces to 0.10% of Si.

25. The method for manufacturing a steel part according to claim 1 wherein the steel composition contains traces to 10 ppm of O.

26. The method for manufacturing a steel part according to claim 1 wherein the steel composition contains between traces to 10 ppm of N.

27. The method for manufacturing a steel part according to claim 1 wherein the steel composition contains between traces to 10 ppm of S.

28. The method for manufacturing a steel part according to claim 27 wherein the steel composition contains between traces to 5 ppm of S.

29. The method for manufacturing a steel part according to claim 1 wherein the steel composition contains between traces to 100 ppm of P.

30. The method for manufacturing a steel part according to claim 1 wherein the steel composition has a measured martensitic transformation temperature Ms greater than or equal to 100° C.

31. The method for manufacturing a steel part according to claim 30 wherein the measured martensitic transformation temperature Ms is greater than or equal to 140° C.

* * * * *